United States Patent [19]

Faulkner

[11] 4,096,815

[45] Jun. 27, 1978

[54] FORMING PROCESS

[75] Inventor: Philip George Faulkner, Banstead, England

[73] Assignee: The British Petroleum Company Limited, London, England

[21] Appl. No.: 700,557

[22] Filed: Jun. 28, 1976

[30] Foreign Application Priority Data

Jul. 8, 1975 United Kingdom ..... 28677/75

[51] Int. Cl.[2] ..... B21D 51/26

[52] U.S. Cl. ..... 113/120 A; 106/285; 427/358; 113/120 H

[58] Field of Search ..... 113/120 A, 120 H; 72/46, 42; 427/239, 358, 385 R, 386, 156, 271, 356, 388 R, 327; 252/56 S; 106/238, 239, 285; 220/64

[56] References Cited

U.S. PATENT DOCUMENTS

| | | | |
|---|---|---|---|
| 3,387,475 | 6/1968 | Seipp | 113/120 A |
| 3,478,554 | 11/1969 | Demsey et al. | 72/46 |
| 3,650,809 | 3/1972 | Gilliam | 427/388 R |
| 3,783,006 | 1/1974 | Hahn et al. | 427/239 |
| 3,832,962 | 9/1974 | Rolles | 113/120 A |
| 3,879,331 | 4/1975 | Parker | 220/64 |
| 3,908,050 | 9/1975 | Gor | 427/239 |
| 3,908,066 | 9/1975 | Parkinson | 427/358 |
| 3,929,550 | 12/1975 | Gaylord | 427/385 |
| 3,939,127 | 2/1976 | Labana | 427/386 |
| 3,968,311 | 7/1976 | Hekal et al. | 427/239 |
| 3,997,694 | 12/1976 | Wu | 428/461 |

FOREIGN PATENT DOCUMENTS

| | | | |
|---|---|---|---|
| 1,035,012 | 7/1966 | United Kingdom. | |
| 1,154,617 | 6/1969 | United Kingdom | 113/120 A |

*Primary Examiner*—Michael J. Keenan
*Attorney, Agent, or Firm*—Brooks, Haidt, Haffner & Delahunty

[57] ABSTRACT

Drawn wall ironing of metal sheets facilitated by pouring a polymer coating on at least one surface of the metal.

11 Claims, No Drawings

FORMING PROCESS

This invention relates to a process for forming metal by working involving predominantly plane strain deformation and particularly a change of gauge, e.g. drawing and ironing, rolling, forging and extruding, and to the metal products so made.

An example of a metal forming involving plane strain deformation and particularly a change of gauge, is the formation of beverage containers by drawing and wall ironing a suitably shaped cup of sheet metal. A recently developed modification of this process known as "draw redraw" produces cans of more uniform thickness and is a further example. In such processes it is usual to use relatively soft metals such as aluminium or specially coated sheet steel, e.g. tin plate, or phosphate treated plate together with special lubricants in order to get satisfactory results with minimum wear to the forming tool. There are great economic advantages in the provision of metal working processes that can eliminate the use of separately added lubricants, which frequently have to be removed from the formed product, and/or in the provision of processes that can be applied directly to untreated sheet steel commonly known as blackplate.

Many proposals have been made to coat metal that is to be worked with various types of plastics material to act as lubricant, but no entirely satisfactory coating has yet been devised for use in a process in which the metal gauge is changed during forming.

An object of the present invention is to provide an improved metal forming process.

Accordingly the present invention provides a process for forming metal involving predominantly plane strain deformation and a change in gauge which comprises providing the metal with a coating of a high molecular weight polyolefin containing in proportion of from 0.1 to 20% by weight of carbonyl groups and/or carboxyl groups and/or organic derivatives thereof and/or carboxylate groups with or without associated metal ions and then forming the metal with the polyolefin acting as lubricant between the forming tool and the metal.

The process of the present invention can be applied to the forming of any metal such as, for example, brass, stainless steel, aluminium, phosphate coated mild steel and chrome/chrome oxide coated mild steel (commercially known as "Hi-top"). However the process has particular economic advantage when applied to untreated steel plate commonly referred to as blackplate.

The high molecular weight polyolefin coating must contain one or more of the named chemical groups in proportion of from 0.1 to 20% by weight or less. Suitably the polyolefin contains from 0.2 to 10% of one or more of the substituent groups, and preferably from 0.2 to 5% by weight. Particularly useful polymers contain from 0.5 to 3% by weight of the substituent group.

The organic derivatives of the carboxyl groups can be esters, e.g. alkyl esters, amides and anhydrides. The preferred high molecular weight polyolefins contain carboxylate groups together with associated metal ions such as sodium, zinc, aluminium, chromium, manganese, molybdenum, nickel, tin, titanium and vanadium ions. Good results are obtained by selecting a metal ion that is known to be capable of forming an alloy with the metal being worked. Thus when working steel useful metal ions are zinc, aluminium, chromium, manganese, molybdenum, nickel, tin, titanium and vanadium.

The substituent groups are suitably introduced into the polyolefin during its formation by polymerisation. For example, the polyolefin can be a copolymer of an olefin and a minor proportion of a copolymerisable monomer containing the required group as such or as part of a different structure from which the desired group can be derived by subsequent chemical treatment of the initially formed copolymer. If desired, however, the substituent group or groups can be introduced into a preformed polyolefin by appropriate treatment of the polymer, for example by radiation grafting. This treatment may be carried out after the metal to be worked has been coated with the polyolefin.

By high molecular weight polyolefin is meant throughout this specification a polyolefin having a melt index, as measured in grammes per 10 minutes according to ASTM method 1238 using a 2.16 kgm load, below 20 and preferably below 10. High molecular weight materials having melt indexes below 1 may be difficult to coat on the metal. Preferred materials have a melt index in the range 2 to 5.

The preferred polyolefin base polymer is polyethylene.

The metal may be coated with the polyolefin by any of the many techniques known in the art. For example, the polyolefin may be applied to the metal surface or surfaces, which is or are to be in contact with the forming tool, from solution in a solvent or dispersion in suitable vehicle such as water or in the molten form. The preferred coating techniques are those in which the polyolefin is heated when in contact with the metal surface. Under these conditions it is thought that any alloying or other chemical reaction between the groups in the polyolefin and the metal surface is brought about rapidly. A particularly preferred coating process comprises dipping the hot metal into a fluidised bed of the polyolefin.

The process of the present invention is particularly useful in the production of beverage containers by the drawing and wall ironing process (DWI process) when the forming tools are dies. In such a process it is possible to coat the opposite sides of the metal with different polyolefins and thus provide different frictional behaviour on the inside and outside of the can during formation. The degree of thickness reduction during formation is a function of the difference in the coefficients of friction in and outside the forming can and thus the proper use of different polyolefins can give advantageous results. Furthermore it may be desirable to provide different polymer coatings on the inside and outside of the formed can having regard to the subsequent different treatment of the two sides of a can.

It is found in many forming processes that the use of the selected polyolefins of the present invention enables very large thickness reductions of the work piece to be obtained in a single pass and that there is no need to use any conventional added lubricants. In general the thicker the coating, the greater the reduction of gauge of metal possible. There is however an optimum thickness which will vary according to the machine used for the deformation. The formed products are produced with the polyolefin coating intact. Such products may be used directly without the need for elaborate washing procedures to remove free lubricants. Moreover, if a final lacquer coating is required on the finished product it can be applied directly on the formed product on which the polyolefin serves in place of a conventional primer. In this case it may be possible to improve corrosion resistance and/or to improve the bonding of the lacquer coat by first irradiating the polymer coating.

The following examples illustrate the process of the present invention as applied on the laboratory scale to the drawing and wall ironing process (DWI process) of small flat discs of sheet metal. Instruments were attached to the apparatus so that the deep draw load and ironing force could be monitored. It should be noted that 1. If, during deep drawing, the stress on the steel exceeds the fracture stress (450 $MN/m^2$) it will not be possible to form it into a cuo. This is equivalent to 9000 Newtons recorded by the laboratory apparatus. A good "lubricant" will give a low deep draw load and a poor lubricant will give a high load.

2. During wall ironing the vertical punch load force divided by the reaction in the die gives an indication of the friction coefficient at the die/metal interface. A good "lubricant" will give a low ratio, and a poor "lubricant" will give a high ratio. If metal/die welding occurs there will be a rapid rise in the ratio. The ratio which will be referred to as the apparent friction coefficient has been averaged over the length of the wall ironed cup in the following examples:

Comparative Example A

A 40 mm diameter disc was punched out of a 0.31 mm thick sheet of blackplate. This was degreased in trichlorethylene vapour. The disc was then dipped in a conventional metal forming lubricant and placed in a deep drawing jig fitted to an Instron tensile machine. The disc was deep drawn into a cup 21 mm diameter by 18 mm deep using a punch speed of 500 mm/min. The maximum load recorded was 7560 N. The wall thickness of the cup varied from 0.31 mm near the base to 0.33 mm at the top.

The cup was then dipped in oil again and subjected to wall ironing in another jig fitted to the Instron testing machine. The wall thickness was reduced to 0.23 mm, the height of the cup was increased to 20 mm, and its diameter reduced to 20.4 mm. The mean apparent coefficient of friction was determined as 0.12 ± 0.02.

EXAMPLE 1

A disc was prepared as in Comparative Example A. The disc was heated to 180° C in a compression moulding press in contact with a polyethylene containing 1% ketonic carbonyl groups measured by Infa Red analysis. On removal from the press the polymer was adhering to the blackplate. The overall thickness of the metal plus polymer was 0.35 mm indicating a polymer thickness of 20 m. This disc was then deep drawn without the addition of a conventional lubricant. The maximum deep draw load was 6840 N and the polymer remained bonded to the metal. The cup was wall ironed and gave a mean apparent coefficient of friction of 0.098 ± 0.004. The height of the cup was approximately 20 mm. The polymer remained adhered to the metal over the majority of the exposed area. This example shows that the coating had better lubricating properties than the conventional oil as in Example A.

EXAMPLE 2

A polymer coated disc was prepared as in Example 1 using a polyethylene containing approximately 2% carboxyl groups (i.e. COOH) and 1% carboxylate groups (i.e. $COO^-$) balanced by sodium ions ($Na^+$). (This type of material is sold commercially as a Surlyn Ionomer resin). The coating thickness was approximately 25μm. This disc was subjected to the DWI process and yielded the following data:

Maximum deep draw load: 6730 N
Mean Apparent friction coefficient: 0.071 ± 0.004
Height of cup: 22 mm
Final adhesion: good The low mean apparent friction coefficient showed that the coating was a more efficient lubricant than the oil used in Example A.

EXAMPLE 3

The polymeric material described in Example 2 was coated on a mild steel disc by preheating the disc in an oven set at 530° C for 20 seconds and dipping immediately into a fluidised bed of the powdered polymer at room temperature, thus bonding a film of polymer to the steel. The disc was then compression moulded in the conventional way to give a coating thickness of 37μm. This was subjected to DWI and gave the following data:

Maximum drawing load: 6750 N
Mean Apparent friction coefficient: 0.06 ± 0.01
Height of cup: 21 mm
Final adhesion: very good The low mean apparent friction coefficient showed that the coating was a more efficient lubricant than the oil used in Example A and the better final adhesion shows the superiority of the method of coating used.

EXAMPLE 4

Blackplate was coated as in Example 2 to give a coating thickness of 92μm. The DWI data was as follows:

Maximum drawing load: 7100 N
Mean Apparent coefficient of friction: 0.06 ± 0.01
Height of cup: 27.5 mm
Final adhesion: slight lifting of polymer at top margin of cup.

This example shows that the thicker coating allowed a greater reduction in gauge in a single pan compared with Example 3.

EXAMPLE 5

A blackplate disc, prepared as in comparative example A was heated in an oven to 400° C and dipped into a polyethylene powder to provide a coating and subsequently compression moulded to give a film thickness of 35μm. The polyethylene (sold commercially as a Surlyn Ionomer resin No. 1706) contained 2.7% carboxyl groups (i.e. COOH) and 1.5% carboxylate groups (i.e. $COO^-$) balanced by zinc ions. The coated disc was subject to DWI and gave the following data:

Maximum drawing load: 7800 N
Mean apparent friction coefficient: 0.06 ± 0.01
Height of cup: 19 mm
Final adhesion: good This example shows that zinc salts can be used successfully as alternative to sodium in Examples 2 and 3.

EXAMPLE 6

A sheet of blackplate 400 mm × 142 mm was degreased using trichloroethylenes. This was placed in an oven at 400° C for 1¼ minutes and removed when a blue colour had formed on the surface of the sheet. Immediately on removal from the oven the powdered polyolefin containing 1.8% carboxyl groups (i.e. COOH) 0.6% carboxylate groups (i.e. $COO^-$) balanced by zinc ions was sprayed on the metal surface using Spraying Systems Inc. spray nozzle. The material is commercially available as Surlyn AD 5001 and marketed by DuPont and has a particle size of approximately 25μm (minimum 5μm maximum 70μm). The sheet was then covered in poly tetra fluoroethylene (PTFE) coated aluminium foil and the whole heated to 250 ± 50° C for three minutes. The composite sheet was then passed through a stanat-mann four high rolling mill to smooth the polyolefin coating. The final coated sheet had an overall thickness of 0.38 mm indicating a polymer coating thickness of 35μm per side. From this sheet discs 40 mm diameter were cut and these were subjected to DWI with the following result.

Maximum drawing load: 6400 N

Mean apparent friction coefficient: 0.060 ± 0.01

Height of cup: 20 mm

Final adhesion: very good

This example shows that sheet can be coated on a larger scale and that DWI results are similar.

I claim:

1. A process for forming a metal workpiece involving predominantly plane strain deformation and a change in gauge and providing an inert coating on the finished workpiece which comprises applying directly on the surface of the metal prior to forming a coating, which is not removed after forming, of a composition consisting essentially of a high molecular weight polyolefin, containing in proportion of from 0.1 to 20% by weight of radicals selected from carbonyl groups, carboxyl groups, organic derivatives thereof, carboxylate groups with associated metal ions and mixtures thereof, and then forming the metal with the polyolefin acting as lubricant between the forming tool and the metal.

2. A process as claimed in claim 1 wherein the polyolefin contains from 0.2 to 10% by weight of one or more of the substituent groups.

3. A process as claimed in claim 1 wherein the polyolefin contains from 0.2 to 5% by weight of one or more of the substituent groups.

4. A process as claimed in claim 1 wherein the polyolefin contains from 0.5 to 3% by weight of one or more of the substituent groups.

5. A process as claimed in claim 1 wherein the organic derivaties of the carboxyl groups are selected from esters, amides and anhydrides.

6. A process as claimed in claim 1 wherein the associated metal ions are capable of alloying with the metal being formed.

7. A process as claimed in claim 1 wherein the metal being formed is steel and the associated metal ions are selected from zinc, aluminium, chromium, manganese, molybdenum, nickel, tin titanium and vanadium.

8. A process as claimed in claim 1 wherein the polyolefin is polyethylene.

9. A process as claimed in claim 1 wherein the metal is provided with a coating of the polyolefin by dipping the hot metal into a bed of fluidised polymer particles.

10. A process as claimed in claim 1 wherein the metal is formed by a drawing and wall ironing.

11. A process as defined in claim 1 wherein said radicals are carboxylate groups.

* * * * *